US009394682B2

(12) United States Patent
Johnson

(10) Patent No.: US 9,394,682 B2
(45) Date of Patent: Jul. 19, 2016

(54) MASONRY ANCHOR

(71) Applicant: MORTAR NET USA, LTD., Burns Harbor, IN (US)

(72) Inventor: Gary R. Johnson, Gary, IN (US)

( * ) Notice: Subject to any disclaimer, the term of this patent is extended or adjusted under 35 U.S.C. 154(b) by 0 days.

(21) Appl. No.: 14/713,921

(22) Filed: May 15, 2015

(65) Prior Publication Data

US 2015/0330069 A1 Nov. 19, 2015

Related U.S. Application Data

(60) Provisional application No. 61/993,496, filed on May 15, 2014.

(51) Int. Cl.
*E04B 1/41* (2006.01)
*E04B 2/42* (2006.01)

(52) U.S. Cl.
CPC ..... *E04B 1/4185* (2013.01); *E04B 1/4178* (2013.01); *E04B 2/42* (2013.01); *E04B 2001/4192* (2013.01)

(58) Field of Classification Search
CPC ..... E04B 1/4178; E04B 1/4185; E04B 2001/4192; E04B 2/42
See application file for complete search history.

(56) References Cited

U.S. PATENT DOCUMENTS 3,300,939 A * 1/1967 Brynjolfsson ..... E04B 1/4185 52/562
3,309,828 A * 3/1967 Tribble ..... E04B 2/10 52/426
3,964,226 A * 6/1976 Hala ..... E04B 2/30 52/562
5,454,200 A * 10/1995 Hohmann ..... E04C 5/16 52/379
6,735,915 B1 * 5/2004 Johnson, III ..... E04B 2/02 52/379
7,152,382 B2 * 12/2006 Johnson, III ..... E04B 2/02 52/426
7,325,366 B1 * 2/2008 Hohmann, Jr. ..... E04B 1/4178 52/167.1
8,613,175 B2 * 12/2013 Hohmann, Jr. ..... E04B 1/4178 52/379
8,726,596 B2 * 5/2014 Hohmann, Jr. ..... E04B 1/4178 52/379
8,733,049 B2 * 5/2014 Hohmann, Jr. ..... E04B 1/4178 52/379
8,833,003 B1 * 9/2014 Hohmann, Jr. ..... E04B 1/98 52/167.1
8,898,980 B2 * 12/2014 Hohmann, Jr. ..... E04B 1/4178 52/379
9,038,351 B2 * 5/2015 Hohmann, Jr. ..... E04B 1/4178 52/714

* cited by examiner

*Primary Examiner* — Andrew J Triggs

(74) *Attorney, Agent, or Firm* — McDonnell, Boehnen, Hulbert & Berghoff LLP

(57) ABSTRACT

A device is described for anchoring and inner wythe in a cavity wall to an outer wythe in order to secure and maintain the position of the inner wythe relative to the outer wythe, the device including a masonry reinforcement retained within the mortar joint of the inner wythe and a plurality of spaced apart brackets attached to the masonry reinforcement, the brackets being formed from a piece of rod stock with terminal end, where at least one eye formed as a turn of the rod stock is disposed between the terminal ends.

17 Claims, 4 Drawing Sheets

MASONRY ANCHOR

FIELD OF THE DISCLOSURE

The disclosure is related to consumer goods and, more particularly, to methods, systems, products, features, services, and other elements directed to media playback or some aspect thereof.

BACKGROUND

In the context of cavity wall structures for construction, the walls are typically formed of two wythes. These may both be of masonry, the wythes being spaced apart to form a vertical space or cavity therebetween. Alternatively, it may have an outer masonry wall such as of bricks, with an inner building wall of wood, wallboard, concrete, concrete masonry units ("CMU"), tile, or similar commonly used interior wythe materials.

It has long been common in the field of cavity wall construction to use masonry anchors or other similar fastening mechanisms in order to anchor the two wythes to one another, thereby forming a conjoined, singular wall structure. Such anchors are typically fabricated from metal, such as steel, and comprise two elements attached, either in manufacture or upon installation, one element being a masonry reinforcement and the other at least one bracket.

Typically, the masonry reinforcement comprises a pair of generally parallel, elongate arms connected by a series of transverse bars. Most commonly, the masonry reinforcement is configured in either a ladder-type configuration with the transverse bars extending perpendicular to the elongate arms, or a truss-type configuration, wherein the transverse bars form a series of triangles with the elongate arms. In installation, the masonry reinforcement is positioned on a mortar joint within the inner wythe and acts as the support structure of the anchoring system. Multiple anchoring systems may be installed on several mortar joints within a particular cavity wall.

Extending externally laterally from the masonry reinforcement are a plurality of spaced-apart brackets. The brackets are typically welded to the inboard (closer the cavity) elongate arm of the masonry reinforcement. That weld may be at each node formed at the junction of an elongate arm and the transverse bar.

Multiple configurations of the brackets are known in the art. For example, a common configuration comprises two "eyes" at the terminal ends of a single U-shaped bracket, as shown in FIG. 1. The eyes receive a fastening member, such as a wall tie, that is affixed to the outer wythe. Typically, such U-shaped brackets are welded to the top of the masonry reinforcement, providing three welding points between the masonry reinforcement and bracket, but placing the masonry reinforcement and bracket on two different horizontal planes. While this configuration generally ensures a strong connection between the masonry reinforcement and bracket, while maintaining a generally horizontal configuration of the bracket relative the mortar joint, the added thickness within the mortar joint may decrease the strength of the wall structure as less mortar may occupy the thickness of the joint.

A similar prior art U-shaped bracket is depicted in U.S. Pat. No. 6,735,915, wherein the base of the "U" is concave, thereby defining two weld points between the masonry reinforcement and bracket. This eliminates the added thickness of the anchoring system when the bracket is welded on top of the masonry reinforcement, as in other prior art systems.

The eyes of the bracket must also provide sufficient strength to withstand tensile stress tending to pull the two wythes apart. Currently, it is known in the art to provide a partially closed eye at the two terminal ends of the U-shaped bracket. In manufacture, such brackets are formed by first bending a single wire to form the U-shaped portion of the bracket, and then performing the secondary operation to bend the two ends of the wire into the semi-circular eye, either prior to or during installation.

The stem of the bracket, i.e. the legs of the "U", must also resist compressive stress.

The Applicant has perceived a need for an improved masonry anchor, and how to accomplish that.

BRIEF DESCRIPTION OF THE DRAWINGS

Features, aspects, and advantages of the presently disclosed technology may be better understood with regard to the following description, appended claims, and accompanying drawings where:

Figure 1:
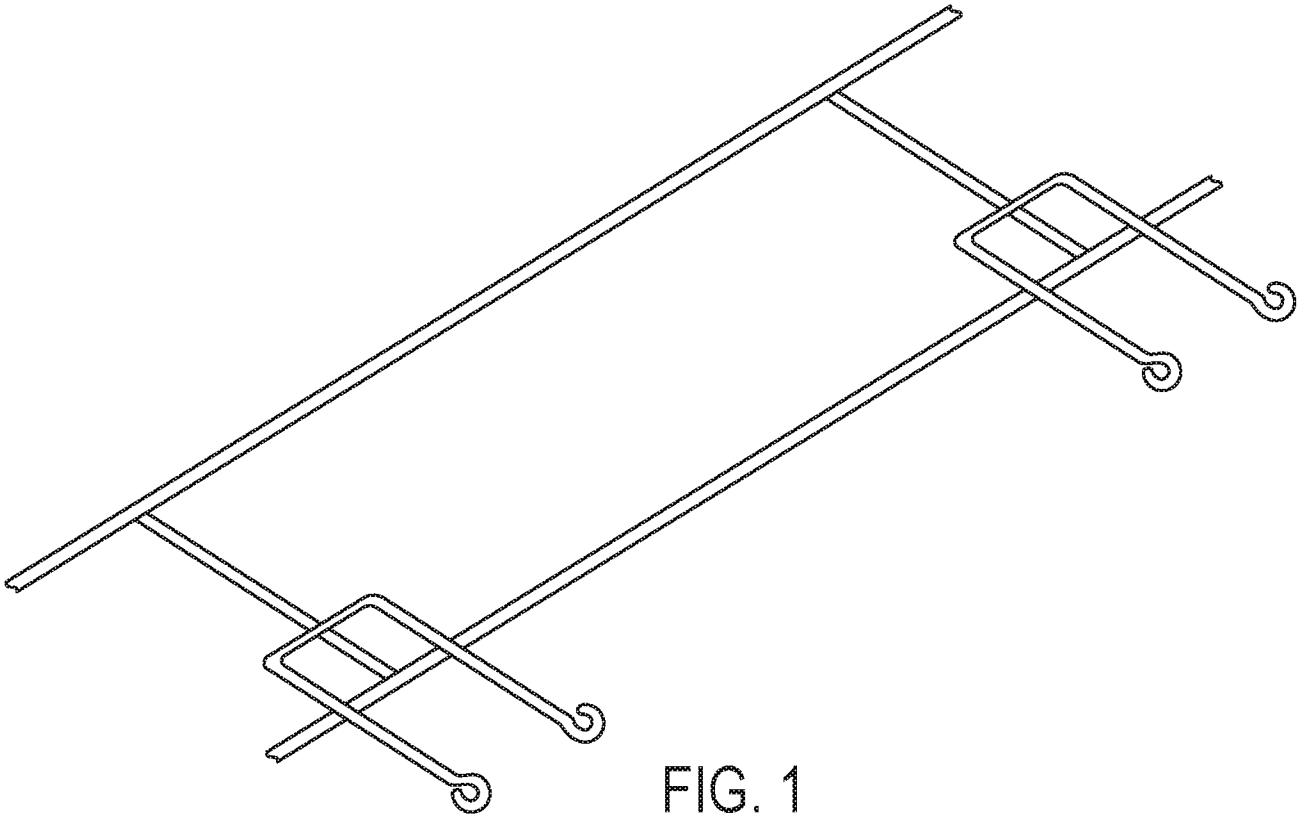
FIG. 1 PRIOR ART
FIG. 1 is a perspective view of a prior art masonry anchor.

The drawings are for the purpose of illustrating example embodiments and may not be drawn to scale. The inventions are not limited to the arrangements and instrumentalities shown in the drawings.

DETAILED DESCRIPTION

Figure 2:
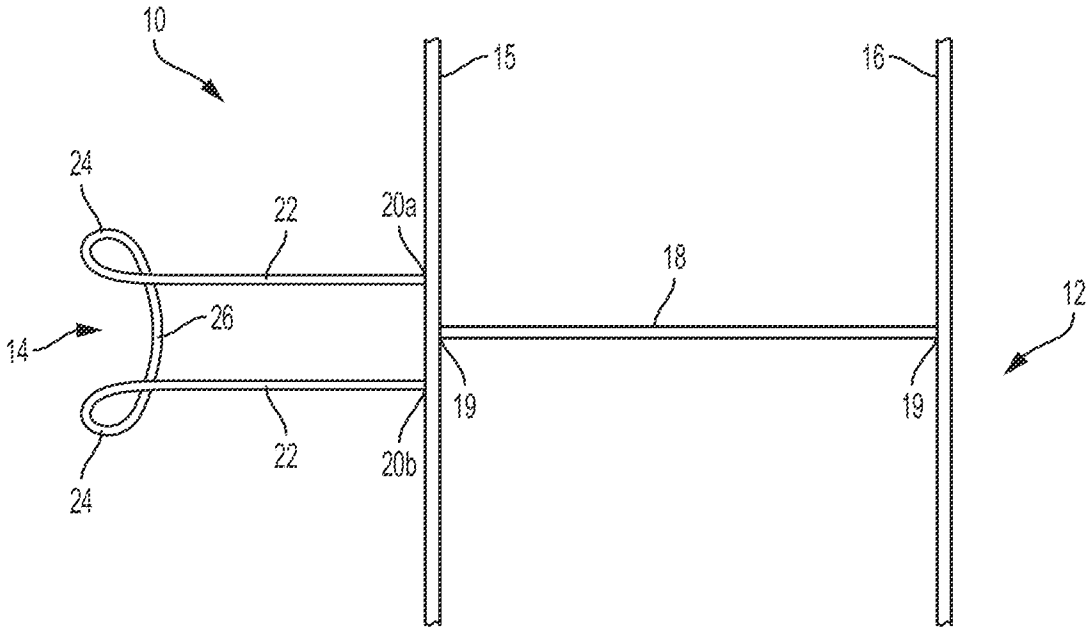
FIG. 2 is a top plan view of an example masonry anchor.
Figure 3:
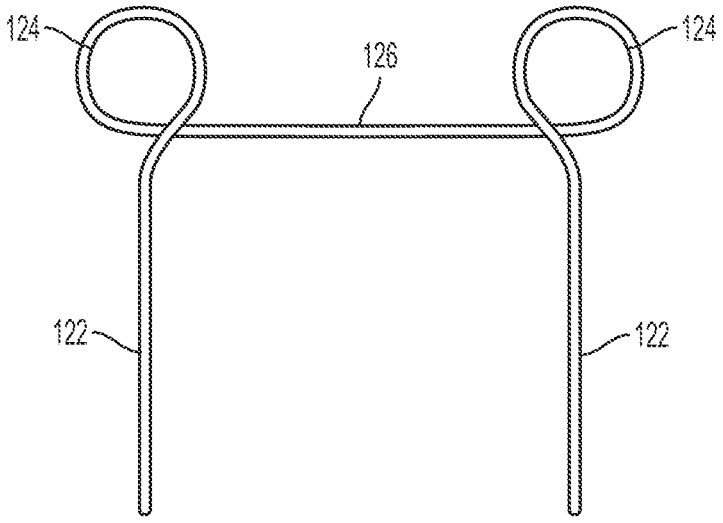
FIG. 3 is a top plan view of another embodiment of a bracket of the masonry anchor of FIG. 2.
Figure 4:
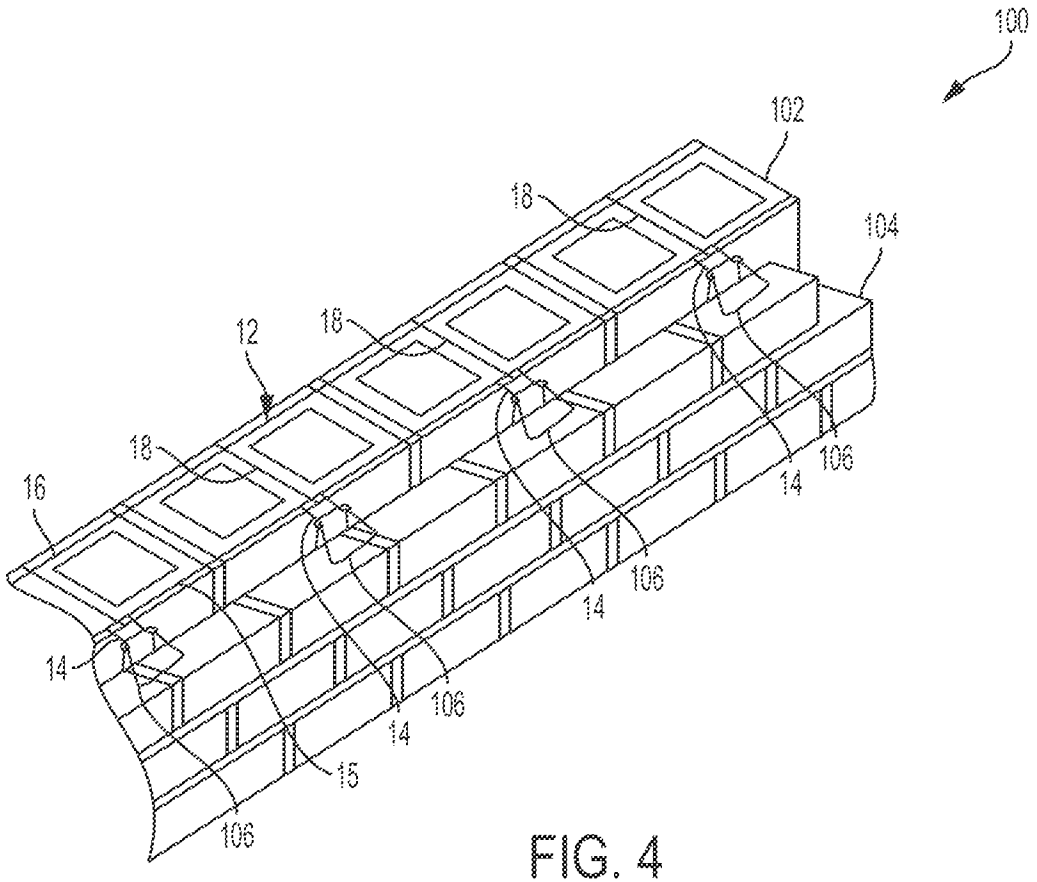
FIG. 4 is a perspective cut-away view of a cavity wall showing the masonry anchor of FIG. 2 upon installation.

Referring to FIGS. 2-4, example embodiments of a masonry anchor are illustrated. The invention relates to a masonry anchor 10 for securing and maintaining the position of an inner wythe 102 of a cavity wall 100 to the outer wythe 104, as shown in FIG. 4. While the invention will be described with respect to specific examples, those skilled in the art will appreciate that there are numerous variations and permutations of the described systems and techniques that fall within the spirit and scope of the invention.

The masonry anchor 10 includes the masonry reinforcement 12 connected to a plurality of brackets 14, typically by welding. More specifically, the bracket 14 may be butt-welded to the masonry reinforcement at the terminal ends 20*a*, 20*b* of each leg 22 of the bracket 14. Welding may be accomplished by electric arc welding, for example. In this example, both the masonry reinforcement 12 and bracket 14 are fabricated from metal, such as steel. This may also be galvanized steel or epoxy-coated rebar, or similarly rigid materials may be used to form the masonry reinforcement 12 and bracket 14. Other materials are also possible.

The masonry reinforcement 12 includes an inboard (closer to the cavity) arm 15 and outboard arm 16 conjoined by a series of spaced-apart transverse members 18, typically equally spaced. In the embodiment depicted in FIG. 2, transverse members 18 run latitudinally (orthogonally) to the arms 15, 16, forming a ladder configuration. Transverse members 18 are spaced apart so as to correspond to the width of the masonry unit, such as a brick or concrete block being used in the inner wythe 102, as shown in FIG. 4. However, it will be understood by those skilled in the art that other configurations, such as a truss configuration, may be employed without departing from the spirit and scope of the invention. The junction between each transverse member 18 and arms 15, 16 forms a node 19.

The brackets 14 include a pair of generally equi-length legs 22 and at least one eye 24. As shown in FIG. 2, one configuration of the bracket 14 comprises a pair of generally parallel legs 22 and a pair of eyes 24 joined by a connecting region 26 located proximal the eyes 24, generally forming a "U" shape. The eyes 24 are adapted to receive a fastening member, such as the fastening member 106 as shown in FIG. 4.

In the example of FIG. 2, the bracket 14 comprises two legs 22 providing two terminal ends 20*a* and 20*b* for butt-welding to the masonry reinforcement 12. The two-leg configuration places the weld points of the bracket in a single plane for uniform connection to the masonry reinforcement 12. In an alternative embodiment, bracket 14 may include two legs 22 and a single eye 24, the bracket generally formed in a "V" shape. It will also be understood that bracket 14 may alternatively include a pair of legs 22 and three or more eyes 24. For example, the third eye may be medially disposed on the connecting region 26 between the dual-eye configuration shown in FIG. 2.

Referring now to the example shown in FIG. 3, a bracket includes a pair of parallel legs 122 and a pair of corresponding eyes 124 joined by a connecting region 126. As depicted in FIG. 3, each leg 122 generally aligns with the center of its corresponding eye 124. This configuration may increase the strength of the masonry anchor 10 by making the legs 122 and the welding points generally subject to pure tension or pure compression, which may reduce the possible torque associated with the configuration of FIG. 2. As such, the bracket of FIG. 3 may withstand a greater force than if the legs 122 were offset from the eyes 124, or if the legs 122 were not generally perpendicular the inboard arm 15 of the masonry reinforcement 12. The FIG. 2 embodiment is nonetheless considered quite viable, as it requires less bending of the bracket 14 and therefore may be easier and/or cheaper to manufacture.

As shown in FIG. 1, the ends of the bracket in prior art masonry anchors terminated in the eyes. As a result, manufacture of prior art brackets requires a multi-step process whereby the "U" shape is formed, and then secondarily, the eyes are "closed." Additionally, such eyes may be weaker and less resistant to tensile stress, (i.e. forces tending to separate the inner wythe from the outer wythe) given the lack of complete closure of the terminally located eyes and their tendency to pull open upon the action of such tensile forces.

In manufacture, the bracket 14 shown in FIG. 2 may be formed from a metal rod stock or wire. In some cases, the bracket 14 may be formed from a single rod stock. To form the eyes 24, the rod stock is spiraled or turned at two points along the rod stock. Because the terminal ends 20*a* and 20*b* are not necessarily fixed upon manufacturing, (as they are when the eyes are formed at the ends of the prior art U-shaped brackets), the present manufacturing process provides the added flexibility to modify the length of the legs 22 depending upon the desired width of the cavity. For example, brackets 14 may be manufactured having one general size for the legs 22, as measured from the terminal ends 20*a*, 20*b* to the center of the eyes 24. The brackets 14 may then be cut to size by shortening the legs 22 at the terminal ends 20*a*, 20*b*.

The eyes 24 of the example bracket 14 shown in FIG. 2 may also provide additional strength as compared to the terminally located eyes present in the prior art. In particular, the eyes 24 are fully closed upon spiraling of the rod stock to form the bracket 14. Thus, any tensile force acting upon the bracket 14 via the fastener-to-eye connection and tending to separate the inner wythe 102 and outer wythe 104 may tighten the eyes 24 around their respective fastening member 106, rather than pull the eyes 24 apart.

While the invention has been described with respect to certain embodiments, variations and modifications will be recognized by those of skill in the art which will nonetheless come within the spirit and scope of the invention, as further set forth in the claims which follow.

I claim:

1. A masonry anchor for connecting an inner and outer wythe of a cavity wall, comprising:

a masonry reinforcement adapted for placement within the inner wythe; and a plurality of brackets connected to and extending laterally outwardly from the masonry reinforcement, wherein each bracket in the plurality of brackets comprises a single piece of rod stock with two terminal ends, wherein at least one eye formed as a turn of the rod stock is disposed between the terminal ends, wherein the at least one eye is fully closed by spiraling of the rod stock, wherein the eye is adapted to receive a fastening member therein, and wherein each bracket in the plurality of brackets is connected to the masonry reinforcement at the two terminal ends.

2. The masonry anchor of claim 1, wherein the masonry reinforcement comprises an inboard and outboard elongated arm and a plurality of transverse members.

3. The masonry anchor of claim 2, wherein the transverse members are orthogonal to the inboard and outboard elongated arms.

4. The masonry anchor of claim 2, wherein the plurality of brackets is spaced apart and connected to the masonry reinforcement generally at a node formed at a junction of the inboard elongated arm and the transverse members.

5. The masonry anchor of claim 1, wherein the brackets are connected to the masonry reinforcement by welding.

6. The masonry anchor of claim 1, wherein the masonry reinforcement and the brackets are formed from a metal.

7. The masonry anchor of claim 1, wherein each bracket in the plurality of brackets further comprises two legs, each leg corresponding to one of the terminal ends, wherein each leg is disposed between its corresponding terminal end and the at least one eye.

8. The masonry anchor of claim 1, wherein each bracket in the plurality of brackets further comprises two legs and two corresponding eyes, wherein each leg is disposed between its corresponding eye and one of the terminal ends.

9. The masonry anchor of claim 8, wherein each leg is aligned with a center of the leg's corresponding eye.

10. The masonry anchor of claim 8, wherein each leg is perpendicular to the inboard elongated arm.

11. A method of anchoring together an inner and outer wythe of a cavity wall, comprising:

positioning a masonry anchor on a mortar joint of the inner wythe, the masonry anchor comprising:

a masonry reinforcement comprising:

an inboard elongated arm;

an outboard elongated arm; and a series of transverse members connecting the inboard and outboard arms; and a plurality of brackets welded to and extending laterally outwardly from the inboard arm of the masonry reinforcement, wherein each bracket in the plurality of brackets comprises a single piece of rod stock with two terminal ends, wherein at least one eye formed as a turn of the rod stock is disposed between the terminal ends, wherein the at least one eye is fully closed by spiraling of the rod stock, wherein the eye is adapted to receive a fastening member therein, and wherein each bracket in the plurality of brackets is connected to the masonry reinforcement at the two terminal ends;

positioning a plurality of fastening members on a mortar joint of the outer wythe, such that the plurality of fastening members are aligned with the eyes of the plurality of brackets; and engaging the fastening members with the eyes.

12. The method of claim 11, further comprising:

affixing the masonry anchor within the mortar joint of the inner wythe; and affixing the fastening members within the mortar joint of the outer wythe.

13. The method of claim 11, wherein the plurality of brackets is spaced apart and connected to the masonry reinforcement generally at a node formed at a junction of the inboard elongated arm and the transverse members.

14. The method of claim 11, wherein each bracket in the plurality of brackets further comprises two legs, each leg corresponding to one of the terminal ends, wherein each leg is disposed between its corresponding terminal end and the at least one eye.

15. The method of claim 11, wherein each bracket in the plurality of brackets further comprises two legs and two corresponding eyes, wherein each leg is disposed between its corresponding eye and one of the terminal ends.

16. The method of claim 15, wherein each leg is aligned with a center of the leg's corresponding eye.

17. The method of claim 15, wherein each leg is perpendicular to the inboard elongated arm.

* * * * *